United States Patent [19]

Ishizaki

[11] 4,375,749

[45] Mar. 8, 1983

[54] MULTIPLE CYLINDER REFRIGERATION APPARATUS

[75] Inventor: Yoshihiro Ishizaki, Kamakura, Japan

[73] Assignee: Aisin Seiki Kabushiki Kaisha, Japan

[21] Appl. No.: 313,793

[22] Filed: Oct. 22, 1981

[30] Foreign Application Priority Data

Oct. 29, 1980 [JP] Japan ..... 55-151632

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,128,605 | 4/1964 | Malaker et al. | 62/6 |
| 3,147,600 | 9/1964 | Malaker et al. | 62/6 |
| 3,310,954 | 3/1967 | Sijtstra et al. | 62/6 |
| 3,372,539 | 3/1968 | Reinhoudt | 62/6 |
| 3,527,049 | 9/1970 | Bush | 62/6 |
| 3,803,857 | 4/1974 | Ishizaki | 62/6 |
| 4,077,216 | 3/1978 | Cooke-Yarborough | 60/520 |

*Primary Examiner*—Ronald C. Capossela

*Attorney, Agent, or Firm*—Finnegan, Henderson, Farabow, Garrett & Dunner

[57] ABSTRACT

A multiple-phase Stirling cycle refrigeration apparatus includes four cylinders accommodating respective pistons and arranged within a cylindrical crank case on a circle concentric therewith. The four cylinders and their pistons are suitably dimensioned, the pistons reciprocated with a phase difference of 90° separating one piston from the next adjacent, and the cylinders suitably interconnected to produce a very low temperature station and a moderately low temperature station, the former disposed at the center of the crank case and surrounded by the latter to faciliate the extraction of two temperature levels and to provide particuarly low temperatures in the very low or cryogenic temperature region.

6 Claims, 4 Drawing Figures

MULTIPLE CYLINDER REFRIGERATION APPARATUS

BACKGROUND OF THE INVENTION

This invention relates to a highly efficient, lightweight and compact refrigeration apparatus which combines four Stirling cycles to enable refrigeration to be achieved at two locations by simultaneously producing very low temperatures in the 5° to 60° K. range and moderately low temperatures in the 30° to 200° K. range.

An object of the present invention is to provide a refrigeration apparatus in which two refrigeration temperature levels produced by the apparatus can be readily extracted for utilization in order to facilitate refrigeration.

Another object of the present invention is to provide a refrigeration apparatus whose refrigerating section is reduced in size, weight and specific volume.

Still another object of the present invention is to provide a refrigeration apparatus having excellent mechanical balance.

A further object of the present invention is to provide a a refrigeration apparatus which exhibits excellent refrigerating efficiency.

According to the present invention, the foregoing and other objects are attained by providing a multiple phase Stirling cycle refrigeration apparatus in which four piston cylinders are arranged within an approximately cylindrical crankcase on a circle concentric with the crankcase. The first and third of the piston cylinders oppose each other across the center of the crankcase and produce very low temperatures, while the second and fourth of the piston cylinders similarly oppose each other across the center of the crankcase and produce moderately low temperatures. Each piston cylinder has a large diameter portion and an elongated small diameter portion and receives a similarly shaped piston adapted to be reciprocated therewithin. The small diameter portion of each piston cylinder and of the respective piston define an expansion space, and the large diameter portion of each piston cylinder and of the respective piston define a compression space on the expansion side of the large diameter portion. Means are provided for reciprocating the pistons within their respective piston cylinders in such a manner that the pistons in the first and third, and in the second and fourth, piston cylinders are displaced in phase by 180°. Means interconnecting the expansion space of one piston cylinder with the compression space of the next adjacent piston cylinder include a heat exchanger and a hold-over device. The heat exchangers connected to the expansion spaces of the very low temperature piston cylinders are combined to form a very low temperature cold space disposed substantially at the center of the four piston cylinders, and the heat exchangers connected to the expansion spaces of the moderately low temperature piston cylinders are combined to form a moderately low temperature cold station disposed to surround the very low temperature cold station. In one aspect of the invention, the small diameter portions of the first and third piston cylinders and of their respective pistons are made smaller in diameter than the small diameter portions of the second and fourth piston cylinders and their respective pistons. According to a feature of the invention, the first and third piston cylinders and their associated hold-over devices are precooled by the hold-over devices or by the cold station associated with the second and fourth piston cylinders. In another aspect of the invention, the compression space of the second piston cylinder is connected to the large diameter portion of the fourth piston cylinder on the non-expansion side of the respective piston, and the compression space of the fourth piston cylinder is connected to the large diameter portion of the second piston cylinder on the non-expansion side of the respective piston, thereby to form compression spaces in the second and fourth piston cylinders on the non-expansion side of the respective pistons.

These and other objects and features of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
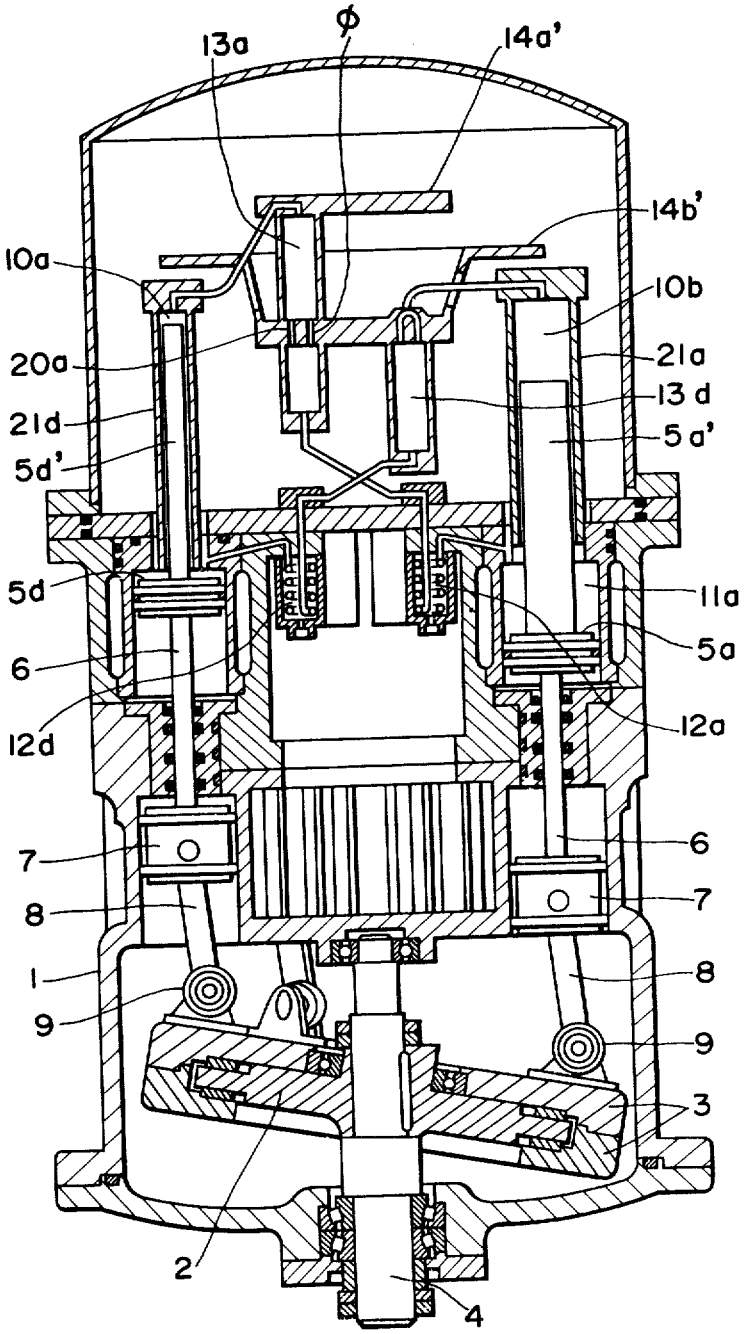
FIG. 1 is a sectional view showing a portion of a refrigeration apparatus embodying the present invention.
Figure 2:
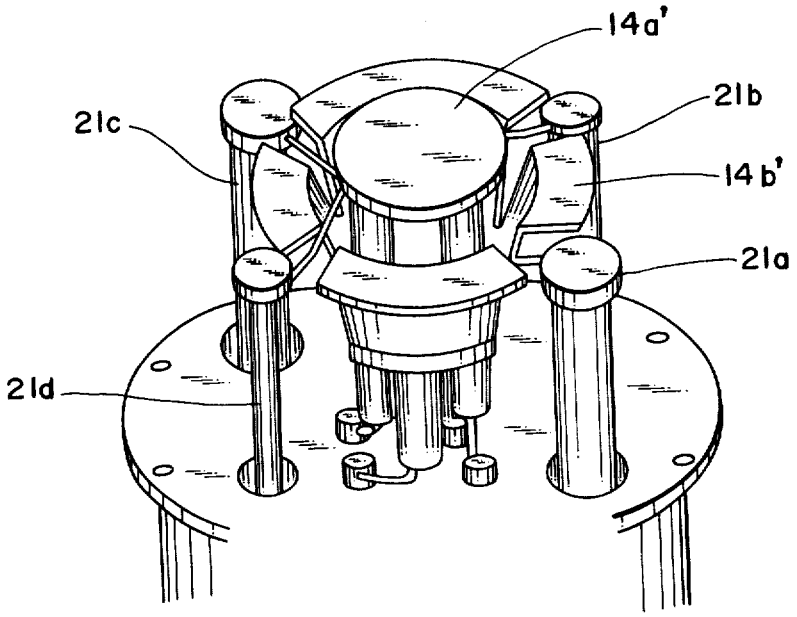
FIG. 2 is a perspective view of a refrigerating section constituting a part of the refrigeration apparatus of FIG. 1.
Figure 3:
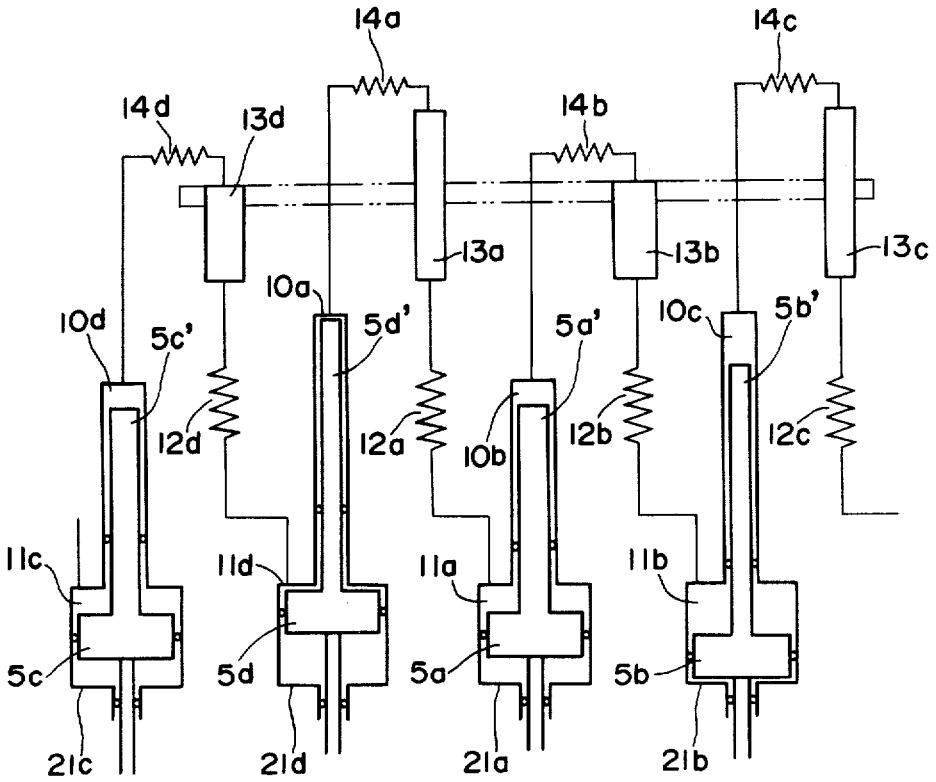
FIG. 3 is an illustrative view useful in describing the principle of operation of the embodiment shown in FIG. 1.

Referring to FIGS. 1 through 3, an approximately cylindrical crank case 1 houses at its lower portion a disk-shaped swashplate 2 which is fixedly supported on a support member 3, as well as a rotary shaft 4 connected to the central portion of the swashplate 2 and having one end thereof projecting outside the crankcase 1 so as to be driven rotatively by a prime mover such as a motor, which is not shown. Four piston cylinders 21*a*, 21*b*, 21*c*, 21*d* are fixedly supported within the crankcase 1 and so arranged as to lie on a circle which is concentric with the crankcase. Each of the piston cylinders 21*a* through 21*d* is composed of a large diameter portion and an elongated small diameter portion. Accommodated within the piston cylinders 21*a* through 21*d* so as to be reciprocated in a manner described below are pistons 5*a* through 5*d*, respectively. Each piston similarly is composed of a large diameter portion and an elongated small diameter portion, the latter being designated at numerals 5*a*' through 5*d*'. The pistons fit snugly in their respective piston cylinders so that, when the pistons are reciprocated, expansion and compression spaces may be formed, as will be described in more detail below.

The pistons 5*a* through 5*d* interconnect with the circumferential portion of the swashplate 2 by way of guide pistons 7, each having a coaxially provided piston rod 6, coupling rods 8 connected at one end to the guide pistons 7, and automatic couplings 9 disposed between the coupling rods 8 and the support member 3 for the swashplate 2. The arrangement is such that rotating the swashplate 2 via the rotary shaft 4 reciprocates the pistons 5*a* through 5*d* within the piston cylinders 21*a* through 21*d* with a phase difference of 90° separating the motion of one piston from the next adjacent piston. Thus pistons 5*a*, 5*c*, and pistons 5*b*, 5*c*, are reciprocated while a phase difference of 180° is maintained between them.

In accordance with the present invention, the elongated, small diameter portions 5*b*', 5*d*' of the pistons 5*b*, 5*d* are made smaller in diameter and larger in length than the elongated, small diameter portions 5*a*', 5*c*' of the pistons 5*a*, 5*c*. Thus the pistons displaced in phase by 180°, namely pistons 5*a*, 5*c* and pistons 5*b*, 5*d*, are identical in shape. Likewise, the elongated, small diameter portions of the piston cylinders 21*b*, 21*d* are made smaller in diameter and larger in length than the elongated, small diameter portions of the piston cylinders 21*a*, 21*c*. The piston cylinders are sized to snugly accommodate the pistons, as described above, and the piston cylinders 21*b*, 21*d*, and 21*a*, 21*c*, are identical in shape. The significance of the foregoing size relationships will become clear from the following discussion.

The structure and operation of the piston cylinders 21*a* through 21*d* and their pistons 5*a* through 5*b* may be understood more clearly from FIG. 3. It will be noted that the small diameter portion of piston cylinder 21*d* delimits an expansion space 10*a* in cooperation with the end of the elongated, small diameter portion 5*d* ' of piston 5*d*. Likewise, expansion spaces 10*b*, 10*c*, 10*d* are delimited by the small diameter portions of piston cylinders 21*a*, 21*b*, 21*c* in cooperation with the ends of the elongated, small diameter portions 5*a*', 5*b*', 5*c*' of pistons 5*a*, 5*b*, 5*c*, respectively. Further, the large diameter portion of piston cylinder 21*d* and the large diameter portion of piston 5*d* delimit a compression space 11*d* on the expansion side of the piston 5*d*. Likewise, compression spaces 11*a*, 11*b*, 11*c* are delimited by the large diameter portions of the piston cylinders 21*a*,21*b*, 21*c* in cooperation with the large diameter portions of the pistons 5*a*, 5*b*, 5*c*, respectively, on the expansion side of each piston. Here the expansion side of a piston is taken to mean that side of the large diameter portion that faces in the direction of the expansion space. That side of the large diameter portion which is opposite the expansion side will therefore be referred to as the non-expansion side.

According to the reciprocating action of the cylinders 5*a* through 5*d*, expansion in the expansion space 10*a* leads compression in the compression space 11*a* by a phase of 90°. The same phase relationship holds between expansion space 10*b* and compression space 11*b*, expanstion space 10*c* and compression space 11*c*, and between expansion space 10*d* and compression space 11*d*. Expansion space 10*a* is connected to compression space 11*a* through a heat exchanger 14*a*, hold-over device 13*a*, and heat exchanger 12*a*. Likewise, expansion space 10*b* is connected to compression space 11*b* through a heat exchanger 14*b*, hold-over device 13*b*, and heat exchanger 12*b*, expansion space 10*c* is connected to compression space 11*c* through a heat exchanger 14*c*, hold-over device 13*c* and heat exchanger 12*c*, and expansion space 10*d* is connected to compression space 11*d* through a heat exchanger 14*d*, hold-over device 13*d* and heat exchanger 12*d*. The heat exchangers 14*a* through 14*d* serve to extract the refrigerating temperatures produced by the refrigeration apparatus.

Thus, four refrigeration circuits are formed, one for each of the piston cylinders 21*a* through 21*d* and their respective pistons 5*a* through 5*d*. Specifically, for piston cylinder 21*a* and its piston 5*a*, the refrigeration circuit is constructed by compression space 11*a*, heat exchanger 12*a*, hold-over device 13*a*, heat exchanger 14*a* and expansion space 10*a*. Similarly, refrigeration circuits constructed of the compression space 11*b*, heat exchanger 12*b*, hold-over device 13*b*, heat exchanger 14*b* and expansion space 10*b*, of the compression space 11*c*, heat exchanger 12*c*, hold-over device 13*c*, heat exchanger 14*c* and expansion space 10*c*, and of the compression space 11*d*, heat exchanger 12*d*, hold-over device 13*d*, heat exchanger 14*d* and expansion space 10*d*, are provided in combination with the piston cylinders 21*b* through 21*c*.

Owing to the fact that the identically shaped pistons 5*b*, 5*d* which are 180° out of phase have small diameter portions 5*b*', 5*d*' which are slenderer and longer than the small diameter portions 5*a*', 5*c*' of the identically shaped pistons 5*a*, 5*c*, the four refrigeration circuits mentioned above in effect form a first refrigeration system comprising two refrigeration circuits which produce very low or cryogenic temperatures, and a second refrigeration system comprising two refrigeration circuits which produce moderately low temperatures. The two refrigeration systems therefore provide two temperature levels. More specifically, of the four refrigeration circuits constructed in association with the piston cylinders 21*a* through 21*b* and their pistons 5*a* through 5*b*, the refrigeration circuits defined by numerals 11*a*, 12*a*, 13*a*, 14*a*, 10*a*, and by numerals 11*c*, 12*c*, 13*c*, 14*c*, 10*c*, construct a first refrigeration system for producing a very low temperature level, and the refrigeration circuits defined by numerals 11*b*, 12*b*, 13*b*, 14*b*, 10*b*, and by 11*d*, 12*d*, 13*d*, 14*d*, 10*d* construct a second refrigeration system for producing moderately low temperature level.

In accordance with the present invention, and as shown in FIGS. 1 and 2, the low-temperature extraction heat exchangers 14*a*, 14*c* of the two refrigeration circuits constructing the first refrigeration system, are combined into a single heat exchanger 14*a*' which serves as a cold station for very low temperatures, while the low-temperature extraction heat exchangers 14*b*, 14*d* of the two refrigeration circuits constructing the second refrigeration system, are combined into a single heat exchanger 14*b*' which serves as a cold station for moderately low temperatures. The first and second refrigeration systems therefore produce refrigerating temperatures independently of each other, enabling a temperature of less than about 60° K. to be obtained from heat exchanger 14*a*', and a temperature of less than about 200° K. to be obtained from the heat exchanger 14*b*'.

To facilitate the production of even lower cryogenic temperatures, the construction of the refrigeration apparatus according to the present invention is such that a portion of the second refrigeration system precools a portion of the first refrigeration system. As shown in FIGS. 1 and 3, this is accomplished by elongating the hold-over devices 13*a*, 13*c* of the first refrigeration system, and by arranging the heat exchanger 14*b*' of the second refrigeration system to cool the intermediate sections of the elongated hold-over devices 13*a*, 13*c*. This reduces the ambient temperature surrounding the hold-over devices 13*a*, 13*c* so that the refrigeration circuitry of the first system can generate lower temperatures more effectively.

Reference will be had to FIG. 1 to describe the above-mentioned construction in more detail. The heat exchanger 14*b*' for extracting the refrigerating temperature of the moderately low level is provided with a multiplicity of apertures $\phi$ on the order of, say, one millimeter in diameter to form gas passages in the refrigeration circuitry of the second refrigeration system. The apertured portions of the heat exchanger 14b' define an intermediate heat exchanger portion 20a for precooling the intermediate section of hold-over device 13a, and another intermediate heat exchanger portion, which is not visible in FIG. 1, for precooling the intermediate section of hold-over device 13c.

The heat exchanger 14a' for providing the very low temperature level of the first refrigeration system, and the heat exchanger 14b' for providing the moderately low temperature level of the second refrigeration system, are formed coaxially and share the same center as the four pistons 5a through 5d, as may be appreciated from FIG. 2 which shows the relationship between the heat exchangers 14a', 14b' and the four piston cylinders 21a through 21d that receive the pistons 5a through 5d, respectively. More specifically, heat exchanger 14a', forming the very low temperature cold station, is disposed substantially at the center of the circle on which the piston cylinders 21a through 21d are arranged. The heat exchanger 14b', forming the moderately low temperature cold station, is arranged at a lower height than the heat exchanger 14a', that is, at a point closer to the driven side of the apparatus, and has its outer circumferential portion extended beyond the outer circumference of the heat exchanger 14a'. Thus the moderately low temperature cold station of heat exchanger 14b' surrounds the very low temperature cold station of heat exchanger 14a'. This arrangement facilitates the extraction of refrigerating temperatures at two temperature levels.

Sealed within the four refrigeration circuits under a pressure of no less than 10 atm. is a working fluid such as air, argon, nitrogen, neon, hydrogen, helium or a mixture thereof.

In operation, a prime mover such as a motor drives the rotary shaft 4 to rotate the swashplate 2, whereby the pistons 5a through 5d are reciprocated vertically within the piston cylinders 21a through 21d with a phase difference of 90° being maintained from one piston to the next adjacent piston. Let us first consider the principle of operation of the refrigeration circuit consisting of the compression space 11b, heat exchanger 12b, hold-over device 13b, heat exchanger 14b and expansion space 10b in the second refrigeration system for providing the moderately low temperature level. As well known in the art, when the working gas in the compression space 11b is compressed by the upward stroke of piston 5b, heat generated by compressing the working gas is dissipated by the heat exchanger 12b as the working gas is introduced into the expansion space 10b in piston cylinder 21a through the hold-over device 13b, the stroke of piston 5a leading that of piston 5b by 90°. Owing to this phase relationship, piston 5a begins its downward stroke before piston 5b, so that the working gas in the expansion space 10b is expanded and therefore cooled. When piston 5a makes its next upward stroke, the cooled working gas is returned to the compression space 11b in piston cylinder 21b through the heat exchanger 14b (14b' in FIG. 1) for moderately low temperature extraction, and the hold-over device 13b. An identical operation is repeated in the refrigeration circuit consisting of the compression space 11d, heat exchanger 12d, hold-over device 13d, heat exchanger 14d and expansion space 10d, but with the intervening phase difference of 180°. As a result, the heat exchangers 14b, 14d, combined to form the heat exchanger 14b' in FIG. 1, produce a refrigerating temperature in the moderately low region of 30° to 200° K. In this case, the design is such that the volume ratio of compression space 11b to expansion space 10b, and of compression space 11d to expansion space 11b, ranges from about 4:1 to about 10:1 in the second refrigeration system.

The fundamental principle of operation is the same for the refrigeration circuit composed of compression space 11a, heat exchanger 12a, hold-over device 13a, heat exchanger 14a and expansion space 10a in the first refrigeration system. Specifically, when the working gas in the compression space 11a of piston cylinder 21a is compressed by the upward stroke of piston 5a, heat generated by compressing the working gas is dissipated by the heat exchanger 12a as the working gas is introduced into the expansion space 10a in piston cylinder 12d through the hold-over device 13a, the stroke of piston 5d leading that of piston 5a by 90°. Owing to this phase relationship, piston 5d begins its downward stroke before piston 5a, so that the working gas in the expansion space 10a is expanded and cooled. When piston 5d makes its next upward stroke, the cooled working gas is returned to the compression space 11a in piston cylinder 21a through the heat exchanger 14a (14a' in FIG. 1) for very low temperature extraction, and the hold-over device 13a. An identical operation is repeated in the refrigeration circuit consisting of the compression space 11c, heat exchanger 12c, hold-over device 13c, heat exchanger 14c and expansion space 10c. As a result, the heat exchangers 14a, 14c, combined to form the heat exchanger 14a' in FIG. 1, produce a refrigerating temperature in the very low temperature range of 5° to 60° K. Thus it will be seen that the very low temperature range of 5° to 60° K. of the first refrigeration system overlaps the moderately low temperature range of 30° to 200° K. of the second refrigeration system.

In order for the first refrigeration system to produce a range of temperatures lower than that of the second refrigeration system, in accordance with the invention the volume ratio of the compression spaces to the expansion spaces in the first refrigeration system is set to from 8:1 to 20:1, and the intermediate sections of the hold-over devices 13a, 13c in the first refrigeration system are precooled by the intermediate heat exchanger portions, one of which is shown at numeral 20 in FIG. 1, using the cold temperatures developed by the refrigeration circuits of the second refrigeration system, as described above. By pre-cooling the hold-over devices 13a, 13c to approximately the temperature of the intermediate heat exchanger portions in this manner, the refrigerating temperature generated by the first system can be made even lower with increased efficiency since the intermediate heat exchanger portions, such as at numeral 20a, serve to hold the temperature extremely low. For example, if the temperature of the intermediate heat exchanger portions is 100° K. with helium as the working gas, a temperature of less than 20° K. can readily be obtained at the heat exchanger 14a' on the very low temperature extraction side.

To obtain the compression space to expansion space volume ratio of 8:1 to 20:1 in the first refrigeration system, and the compression space to expansion space volume ratio of 4:1 to 10:1 in the second refrigeration system, the small diameter portions 5b', 5d' of the pistons 5b, 5d and of the piston cylinders 21b, 21d that delimit the expansion spaces 10a, 10c in the first refrigeration system, are made smaller than the small diameter portions 5a', 5c' of the pistons 5a, 5c and of the piston cylinders 21a, 21c that delimit the expansion spaces 10b, 10d in the second refrigeration system, as described above.

Figure 4:
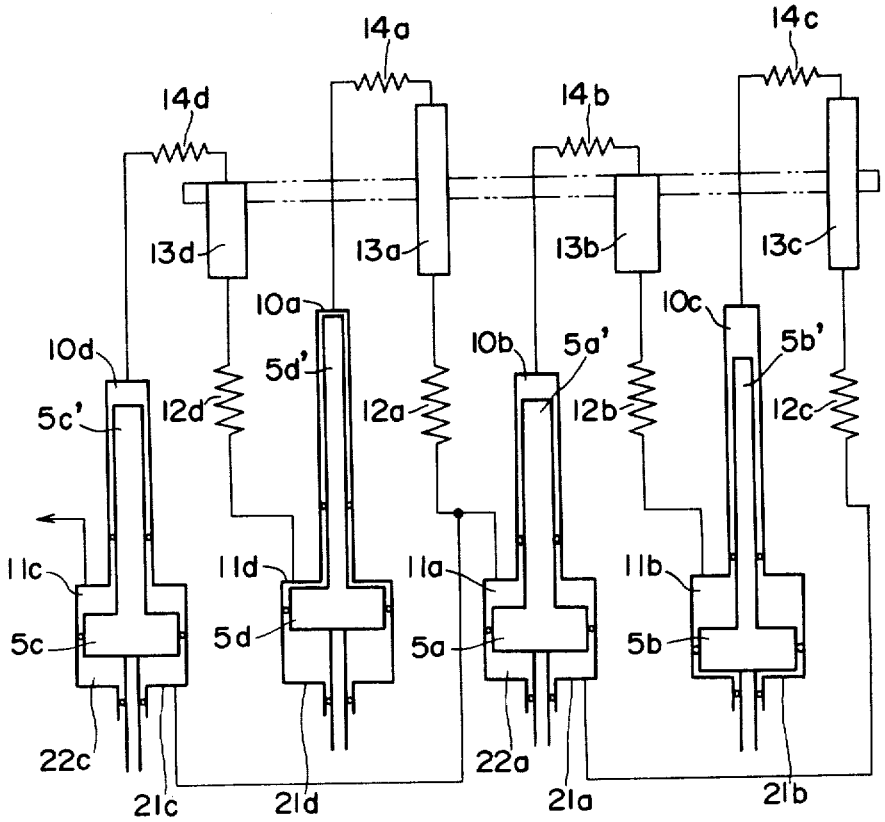
FIG. 4 is an illustrative view useful in describing the principle of operation of another embodiment of a refrigeration apparatus according to the present invention.

The abovementioned volume ratios can also be established by increasing the volume of the compression spaces in the refrigeration circuits of the first refrigeration system, as shown in the arrangement of FIG. 4 constituting a second embodiment of the present invention. As illustrated in FIG. 4, the volume of the compression spaces is increased by interconnecting the compression space 11a, delimited within the large diameter portion of the piston cylinder 21a on the expansion side of the piston 5a, with the space 22c delimited within the large diameter portion of the piston cylinder 21c on the non-expansion side of the piston 5c, and similarly by interconnecting the compression space 11c in piston cylinder 21c with space 22a on the non-expansion side of piston 5a in piston cylinder 21a. This arrangement converts the spaces 22a, 22c into compression spaces, thereby increasing the total compression volume of the first refrigeration system by the total volume of the spaces 22a, 22c on the non-expansion side of pistons 5a, 5c. This holds true because the change in the volume of spaces 22a, 22c as pistons 5a, 5c reciprocate in piston cylinders 21a, 21c, is the same as that of the compression spaces 11a, 11c, owing to the 180° phase difference between the pistons 5a, 5c.

In the second embodiment, compression spaces 22a, 22c are formed by interconnecting the piston cylinders 21a, 21c in the fashion described. It should be noted, however, that two additional compression spaces can be formed on the non-expansion sides of pistons 5b, 5d by interconnecting piston cylinders 21b, 21d in the same manner as the other piston cylinder pair. Thus, in accordance with the present invention, it is possible to provide four, six or eight compression spaces.

The multiple cylinder refrigeration apparatus of the present invention as described and illustrated in connection with the foregoing preferred embodiments is possessed of the following outstanding actions and effects:

(1) The two cold stations for the very low and moderately low temperature levels can be made compact, and it is possible to reduce their heat capacity to shorten the pre-cooling time. These results are obtained by providing the two very low and moderately low refrigerating temperature extraction stations substantially concentrically and at the center of the four surrounding piston cylinders. This construction is achieved by arranging the four piston cylinders within the crankcase on a circle concentric therewith, with one pair of piston cylinders facing each other across the center of the crankcase being adapted to generate very low temperatures, while the other pair of piston cylinders generate moderately low temperatures, and by disposing the very low temperature station substantially at the center of the crankcase, surrounded by the moderately low temperature station. The foregoing construction also facilitates the mounting operation.

(2) Since the two cold stations can be made more compact, thermal penetration due to radiation and gas can be reduced.

(3) Since the two cylinders and hold-over devices for producing the very low temperatures are pre-cooled either by the hold-over devices or cold stations for producing the moderately low temperatures, the refrigeration provided by the expansion spaces of the first refrigeration system can be generated and utilized more effectively, enabling even lower temperatures to be attained in the very low temperature region.

(4) By making the small diameter portions of one pair of piston cylinders which are separated in phase by 180°, and of their respective cylinders, smaller than the other pair of piston cylinders which are separated in phase by 180°, and of their respective pistons, thereby to establish a very cold temperature system, excellent mechanical balance can be obtained between the first and second refrigeration systems to reduce vibration and noise.

(5) Since four, six or eight compression spaces can be established as described above, the total compression volume can be enlarged without increasing the size of the large diameter portion of the piston in each refrigeration circuit. The overall apparatus can therefore be reduced in size, and mechanical losses can be minimized.

As many apparently widely different embodiments of the present invention may be made without departing from the spirit and scope thereof, it is to be understood that the invention is not limited to the specific embodiments thereof except as defined in the appended claims.

What we claim is:

1. A multiple-phase Stirling cycle refrigeration apparatus housed in an approximately cylindrical crankcase, which comprises:

first, second, third and fourth piston cylinders arranged within the crankcase on a circle concentric therewith, said first and third piston cylinders, and said second and fourth piston cylinders, opposing each other across the center of the crankcase, said first and third piston cylinders being adapted to produce very low temperatures, said second and fourth piston cylinders being adapted to produce moderately low temperatures, each piston cylinder having a large diameter portion and an elongated small diameter portion;

first, second, third and fourth pistons adapted for reciprocation within respective ones of said first through fourth piston cylinders, each piston having a large diameter portion and an elongated small diameter portion corresponding to the large and small diameter portions of the respective piston cylinder;

the small diameter portion of each piston cylinder and of the respective piston within said piston cylinder delimiting an expansion space, the large diameter portion of each piston cylinder and of the respective piston within said piston cylinder delimiting a compression space on the expansion side of the large diameter portion of said piston;

means interconnecting the expansion space of one piston cylinder with the compression space of the next adjacent piston cylinder for extracting refrigerating temperatures; and means for reciprocating said first through fourth pistons within said first through fourth piston cylinders in such a manner that said first and third pistons in said first and third piston cylinders, and said second and fourth pistons in said second and fourth piston cylinders, are displaced in phase by 180°.

2. The multiple-phase Stirling cycle refrigeration apparatus according to claim 1, in which said means for interconnecting the expansion and compression spaces include:

a heat exchanger having two ends of which one is connected to the expansion space;

a hold-over device having two ends of which one is connected to the other end of said heat exchanger; and a heat exchanger having one end thereof connected to the other end of said hold-over device and the other end thereof connected to the compression space;

said heat exchangers connected to the expansion spaces of said first and third piston cylinders being combined to form a very low temperature cold station disposed substantially at the center of the circle on which said first through fourth piston cylinders are arranged;

said heat exchangers connected to the expansion spaces of said second and fourth piston cylinders being combined to form a moderately low temperature cold station disposed to surround said very low temperature cold station.

3. The multiple-phase Stirling cycle refrigeration apparatus according to claim 2, in which said first and third piston cylinders and said hold-over devices connected thereto are precooled by said hold-over devices connected to said second and fourth piston cylinders.

4. The multiple-phase Stirling cycle refrigeration apparatus according to claim 2, in which said first and third piston cylinders and said hold-over devices connected thereto are precooled by said cold station connected to said second and fourth piston cylinders.

5. The multiple-phase Stirling cycle refrigeration apparatus according to claim 1, in which the small diameter portions of the first and third piston cylinders and of their respective first and third pistons are smaller in diameter than the small diameter portions of the second and fourth piston cylinders and of their respective second and fourth pistons.

6. The multiple-phase Stirling cycle refrigeration apparatus according to claim 1, in which at least said second and fourth piston cylinders are so interconnected that the compression space of said second piston cylinder is connected to the large diameter portion of said fourth piston cylinder on the non-expansion side of the respective fourth piston, and the compression space and said fourth piston cylinder is connected to the large diameter portion of said second piston cylinder on the non-expansion side of the respective second piston, thereby to form compression spaces in said second and fourth piston cylinders on the non-expansion sides of said second and fourth pistons.

* * * * *